United States Patent [19]

Hoffman et al.

[11] 4,453,326

[45] Jun. 12, 1984

[54] DOCUMENT HOLDING AND SEGREGATING DEVICE

[75] Inventors: Craig A. Hoffman, Dallas; William D. Lawrence, Lewisville, both of Tex.

[73] Assignee: Dynamic Resources Unlimited, Inc., Waco, Tex.

[21] Appl. No.: 395,134

[22] Filed: Jul. 6, 1982

[51] Int. Cl.[3] ..... A47B 49/00

[52] U.S. Cl. ..... 40/377; 211/131; 211/129; 211/78; 312/186; 312/197; 312/305

[58] Field of Search ..... 40/377, 378, 379; 211/131, 129, 202, 78; 312/257 A, 183, 193, 305, 197, 186

[56] References Cited

U.S. PATENT DOCUMENTS

| | | | |
|---|---|---|---|
| 630,755 | 8/1899 | Stephan | 40/377 |
| 2,711,741 | 6/1955 | Wassell | 312/183 |
| 3,244,289 | 4/1966 | King | 40/377 |
| 3,279,471 | 10/1966 | Ruina | 40/379 |
| 4,049,330 | 9/1977 | Schlapp | 312/186 |
| 4,239,311 | 12/1980 | Brownlee et al. | 312/305 |

*Primary Examiner*—Gene Mancene
*Assistant Examiner*—James Hakomaki
*Attorney, Agent, or Firm*—Kenneth R. Glaser

[57] ABSTRACT

A document holding and segregating device includes a generally cylindrical body member having radially projecting partitions forming a plurality of compartments for holding documents such as communication memos, etc. The body member includes a central hub having a hollow axial bore and a thrust bearing surface at one end of the bore. The body member is mounted on a cylindrical base member having an upstanding bearing post insertable in the bore in the hub of the body member whereby the body member may be mounted for rotation on the base to enhance its use in receiving and dispensing documents.

3 Claims, 4 Drawing Figures

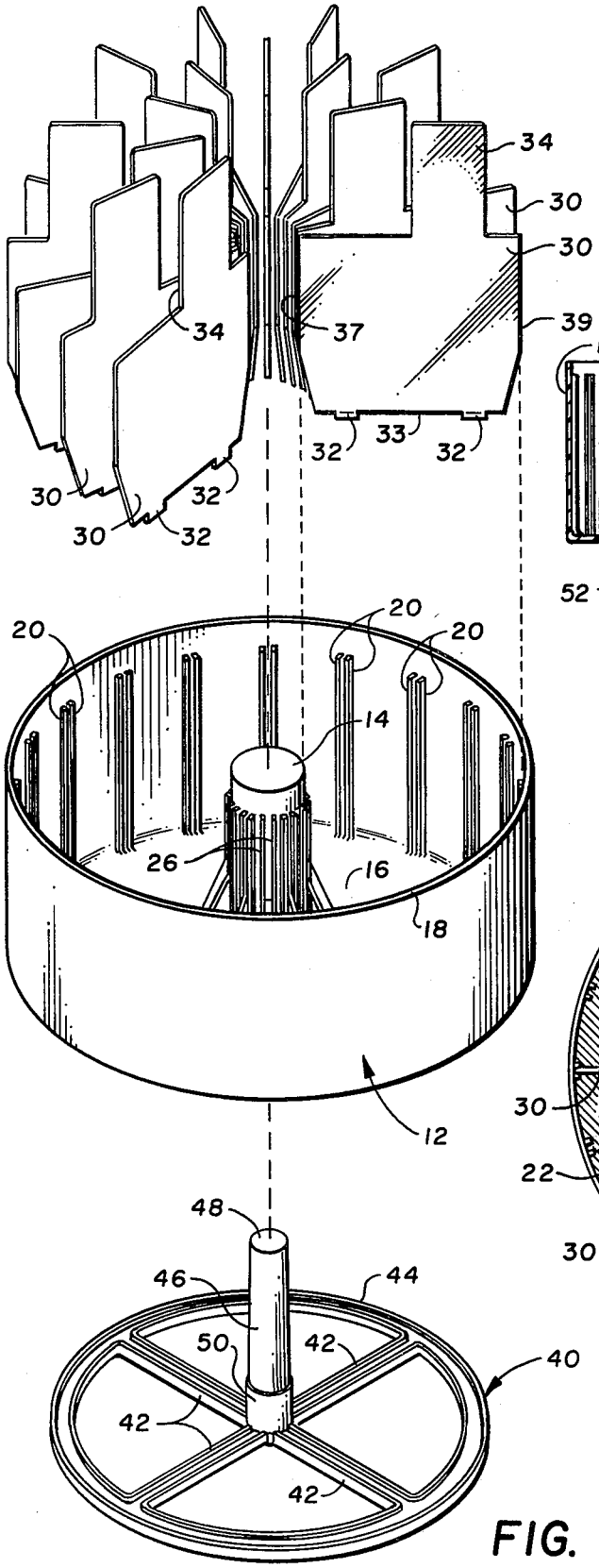
FIG. 1
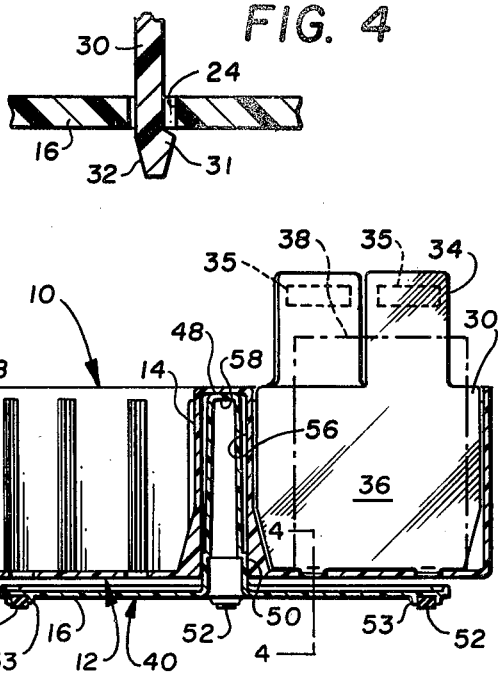
FIG. 4
FIG. 2
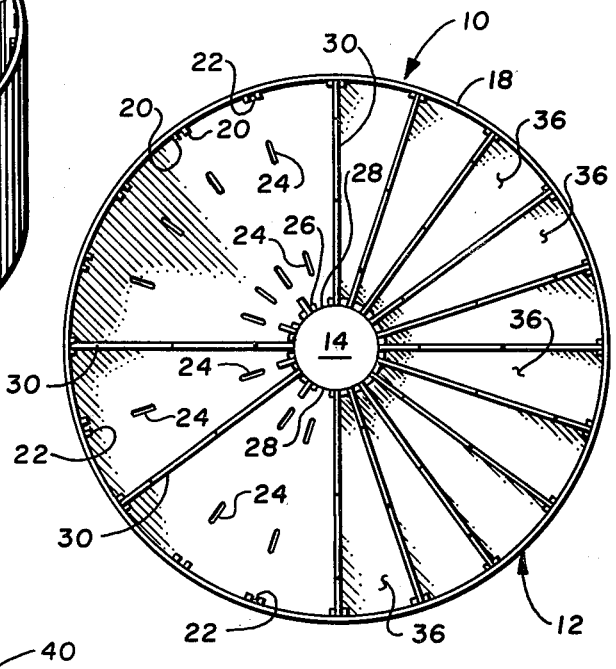
FIG. 3

DOCUMENT HOLDING AND SEGREGATING DEVICE

BACKGROUND OF THE INVENTION

Field of the Invention

This invention pertains to a device for holding a plurality of documents such as communication memos or the like addressed to plurality of different entities and wherein the documents must be held and segregated according to the identity of the entity such as an individual or department within the offices of an organization.

In many offices, communication memos and telephone response messages are handled by a single person such as a receptionist or telephone system operator. Also, the organization of many offices is such that a particular individual is responsible for gathering and distributing documents to different entities, namely individual executives or departments within the office complex itself. In this regard, it is particularly desirable to have a device which may be placed on a receptionist's desk or the like for segregating documents addressed to different entities such as individual persons or departments so that the documents do not become misplaced or misdirected and so that an individual can readily ascertain if any documents are addressed to him and are currently awaiting pickup thus increasing office efficiency and productivity. Although different processes and apparatus have been provided for holding and segregating documents such as communication memos and the like, known types of apparatus have several shortcomings, namely they are bulky and do not readily fit on a desk or table, are somewhat unsightly in appearance, and are not readily viewable or operable by individuals to ascertain if a document is awaiting pickup by the entity to which it is addressed.

In an effort to overcome the deficiencies of the prior art, the present invention has solved several of the problems and has met desiderata pertaining to a device for use in the distribution of documents in an office or the like.

SUMMARY OF THE INVENTION

The present invention pertains to a document holding and segregating device which is particularly adapted for use in an office for holding documents such as communication memos, i.e. telephone messages, and other documents addressed to different entities within the office including individuals or departments. In accordance with one aspect of the present invention, there is provided a document holding device having a plurality of compartments formed in a generally cylindrical body member wherein a plurality of radially extending partitions are provided to form separate compartments and wherein each partition has a vertically extending projection on which identifying indicia may be provided to identify the entity associated with each compartment.

In accordance with another aspect of the present invention, there is provided a document holding and segregating device which is adapted to be readily viewed to determine whether or not any documents are awaiting pickup by a particular entity. In accordance with yet another aspect of the present invention, there is provided a document holding and segregating device having a substantial number of separate compartments, which device may be rotated to bring into proximity of the individual viewing the device selected ones of the compartments to facilitate receiving or dispensing documents. Still further in accordance with the present invention, there is provided a document holding and segregating device which may be easily placed on the desk of a receptionist or telephone system operator in an office complex or the like, which device is pleasing in appearance and does not require a great deal of room on the surface of a desk or other appropriate point of placement of the device.

Those skilled in the art will appreciate the various advantages and superior features of the document holding and segregating device upon reading the detailed description which follows in conjunction with the drawing.

BRIEF DESCRIPTION OF THE DRAWING

FIG. 1 is an exploded perspective view of the document holding and segregating device in accordance with the present invention;

FIG. 2 is a vertical central section view of the device illustrated in FIG. 1 with the parts assembled;

FIG. 3 is a plan view showing several of the partitions disposed in the body member of the device; and FIG. 4 is a detail section view taken along the line 4—4 of FIG. 2.

DESCRIPTION OF THE PREFERRED EMBODIMENT

Referring to the drawing figures, there is illustrated a document holding and segregating device which is generally designated by the numeral 10. The device 10 is characterized by a generally cylindrical body member 12 including a central hollow hub portion 14, a bottom wall 16 and a circumferential sidewall integral with the bottom wall and designated by the numeral 18. As shown in FIG. 1, in particular, the inner wall surface of the sidewall 18 is provided with circumferentially spaced pairs of axially extending ridges 20 and forming, between respective pairs of said ridges, channel portions designated by the numeral 22 in FIG. 3. The channel portions 22 are aligned with elongated slots 24 spaced apart and extending along radial lines passing through the centers of the channels 22, as illustrated in FIG. 3. At least two spaced apart slots 24 are formed on a radial line passing through the center of each channel 22. The body member 12 is also characterized by axially extending ridges 26 formed on the hub portion 14 to define channels 28 which are also aligned with the slots 24 and the channels 22.

As shown in the drawing figures, respective aligned channels 22, slots 24 and channels 28 are adapted to receive partitions designated by the numeral 30, several of which are illustrated in FIG. 1. The partitions 30 are each provided with spaced apart projections 32 extending from a horizontal bottom edge 33 and spaced so as to fit into respective ones of the slots 24 when the partitions are inserted into the body member and within the channels 22 and 28, respectively. Referring briefly to FIG. 4, the projections 32 are each provided with laterally extending ledges 31 which are positioned on the projections with respect to the bottom edge 33 such that, when the partitions are in position in the body member, the ledges normally engage the underside of bottom wall 16 to assist in retaining the partitions in the body member.

Each of the partitions 30 are preferably formed of a relatively thin platelike member having a vertically upstanding tab 34 on which suitable identifying indicia may be printed at 35, FIG. 2, to identify a department, or a particular individual within an office environment. The partitions 30 are formed with symmetrical opposed sides 37 and 39 whereby alternate ones of the partitions may be inserted in the body member with the tabs staggered or spaced apart radially with respect to the hub 14, as shown, for increased visibility of the tabs.

The partitions 30, when placed in the body member 12 as shown in FIGS. 2 and 3, divide the interior of the body member into a plurality of separate document receiving compartments 36. Each of the compartments 36 is suitably identified with one of the partitions forming the compartment whereby documents addressed to the entity identified on the tab 34 may be placed for pick up and distribution to that entity. For example, as shown in FIG. 2, a document such as message or communication memo, designated by the numeral 38, is disposed in one of the compartments 36 and elated to an entity identified on the tab 34 pertaining to that compartment. The particular compartment 36 illustrated in FIG. 2 may be related to the entity identified on the tab 34 by the indicia 35 to avoid confusion with the possibility that the tab 34 actually identifies the adjacent compartment 36. Normally, it would be assumed that the compartment with which a particular entity was associated would be that adjacent to or defined by the side of the partition 30 having the indicia printed thereon.

As will be appreciated viewing FIG. 3, a sizable number of compartments 36 may be formed in the body member 12 using a plurality of partitions of the type shown and described herein. In fact, for a body member having a nominal outside diameter of approximately eleven inches and a hub diameter of approximately one inch, a total of twenty compartments may be easily formed of sufficient width to hold several documents in each compartment.

The document holding device 10 is further characterized by a base member, generally designated by the numeral 40 in FIGS. 1 and 2, and comprising a circular ringlike member having a plurality of radially extending spokes 42 and an outer rim 44. The base member 40 also includes a vertically upstanding cylindrical post member extending from the intersection of the spokes 42. The post member 46 includes a transverse bearing surface 48 formed on the distal end thereof and a generally cylindrical guide or bearing surface 50 formed adjacent to the juncture of the post with the spokes 42.

As shown in FIG. 2, the underside of the base member 40 may be provided with support feet comprising antiskid and antimarring pads 52 which are positioned on the base member at the juncture of each of the spokes 42 with the outer rim 44. The pads 52 are positioned within locating rings 53 molded integral with the base member 40. The pads 52 are preferably formed of neoprene or the like and are secured to the base member 40 with a suitable adhesive.

As shown also in FIG. 2, the hub 14 is provided with a bore 56 for receiving the post 46 whereby the bearing surface 48 on the post cooperates with a bearing surface 58 on the inner end wall of the hub 14. The bore 56 is suitably formed to be slightly larger in diameter than the diameter of the bearing surface 50 so that when the body member 12 is mounted on the base 40 it is suitably guided by the bearing surface 50 but is adapted to permit free rotation of the body member with respect to the base.

The document holding device 10 is preferably formed of a suitable injection molded plastic and may be provided in several decorator colors to enhance the attractiveness of the device. The body member 12 and the base 40 may both be formed as separate integral parts. The dimensions of the opposed sidewalls of the partitions 30 may be such that the partitions are a snug sliding fit within the channels 22 and 28 to assist the retaining action of the projections 32 so that the partitions are required to be relatively firmly grasped and pulled for removal from the body member.

In use, the document holding and segregating device 10 may be provided with any number of the partitions 30 according to the number of compartments 36 required and the number of documents normally accruing in a compartment before distribution to the entity addressed by the documents. For example, if a particular entity normally received a great number of messages or documents over relatively short period of time, the compartment associated with that entity might be made larger than other compartments by removing one or more of the partitions 30 as shown in FIG. 3. The size of a compartment can, of course, be selectively varied in accordance with the placement of partitions 30. The device is normally placed on receptionist's desk, the desk of a mail sorting and handling person or the desk of a telephone system operator whereby documents and messages can be collected and deposited in respective ones of the compartments 36 associated with the respective entities identified on the tabs 34. A person passing the document holding device 10 may readily view the device to determine if any documents are in the compartment identified with that individual. Moreover, the body member 12 may be easily rotated to bring the tabs 34 into view by the individual inspecting the device to determine if any documents are awaiting distribution from the compartment identified with that particular individual.

Those skilled in the art will appreciate that the device described herein may take certain other forms or be modified in ways which will fall within the scope and spirit of the present invention as defined in the appended claims.

What we claim is:

1. A document holding and segregating device particularly adapted for table top use to retain documents such as communication memos and the like addressed to plurality of different entities whereby said documents may be identified by the entity to whom they are addressed and are segregated from documents addressed to the other entities, said device comprising:

a generally cylindrical body member adapted to rotate about a vertical axis, said body member including a central hub portion, a bottom wall secured to said hub portion, and an upstanding circumferential sidewall secured to said bottom wall and defining an open top;

a plurality of vertically upstanding spaced apart partitions extending radially outward from said hub portion toward said sidewall and dividing said body member into a plurality of document receiving compartments, said partitions being removably mountable on said body member and located on said body member by means on said body member defining a channel for receiving a side edge of each of said partitions, said partitions including spaced apart projections formed on a bottom edge thereof and insertable in cooperating slots formed in said bottom wall of said body member, said partition projections including integral ledges projecting from one side and engageable with said bottom wall for retaining said partition in said body member;

display means comprising vertically upstanding tabs integral with each of said plurality of spaced apart partitions for displaying optical indicia to identify respective ones of said compartments with an associated entity; and support means for supporting said body member for rotation about a generally vertical axis passing through said hub for selectively positioning respective ones of said compartments for inspection, insertion or removal of documents, said support means comprising a base including a member having a centrally disposed post extending from one side of said member and adapted to be inserted in a bore in said hub portion for supporting said body member rotatably on said base by cooperating thrust bearing surfaces formed on said post and in said bore of said hub portion, said thrust bearing surfaces being formed on one end of said post and at one end of said bore in said hub portion, respectively, and including a cylindrical bearing surface formed on said post opposite said one end of said post and engageable with the bore wall of said hub portion.

2. The document holding device set forth in claim 1 wherein:

said partitions may be installed in said body member such that the tabs on adjacent partitions are disposed at different radial positions with respect to said hub portion.

3. The document holding device set forth in claim 1 wherein:

said body member, said partitions and said base are separately formed of molded plastic.

* * * * *